United States Patent [19]

Harris

[11] 4,295,403

[45] Oct. 20, 1981

[54] ADJUSTABLE NECK ATTACHMENT FOR STRINGED INSTRUMENTS

[76] Inventor: Jeff B. Harris, 10275 SW. Century Oak Dr., Tigard, Oreg. 97223

[21] Appl. No.: 220,080

[22] Filed: Dec. 24, 1980

[51] Int. Cl.[3] ..... G10D 3/00

[52] U.S. Cl. ..... 84/293; 84/269; 84/299

[58] Field of Search ..... 84/473, 267–269, 84/290–293

[56] References Cited

U.S. PATENT DOCUMENTS

| | | | |
|---|---|---|---|
| 1,785,266 | 12/1930 | Lange | 84/293 |
| 1,803,100 | 4/1931 | Dopyera | 84/269 |
| 2,087,631 | 7/1937 | Simpson | 84/293 |
| 2,113,446 | 4/1938 | Gugino | 84/293 |

FOREIGN PATENT DOCUMENTS

| | | | |
|---|---|---|---|
| 1026628 | 4/1953 | France | 84/293 |

*Primary Examiner*—Lawrence R. Franklin
*Attorney, Agent, or Firm*—Chernoff & Vilhauer

[57] ABSTRACT

An attachment device for adjustably mounting the neck to the body of a stringed musical instrument, for example a banjo, has a pair of plates for attachment respectively to the neck and body of the banjo. A pivot point locates one plate with respect to the other, and a pair of adjustment screws interconnect the plates, cooperatively controlling the angle at which the neck extends away from the body. Elongated holes in one of the adapter plates receive the adjustment screws, permitting the neck to be rotated with respect to the body, about the longitudinal axis of the neck. The device may include a brace bar extending across the body of the instrument to hold a tailpiece. A setscrew opposes tension in the adjustment screws to hold the plates in desired relative positions.

9 Claims, 4 Drawing Figures

FIG. 1
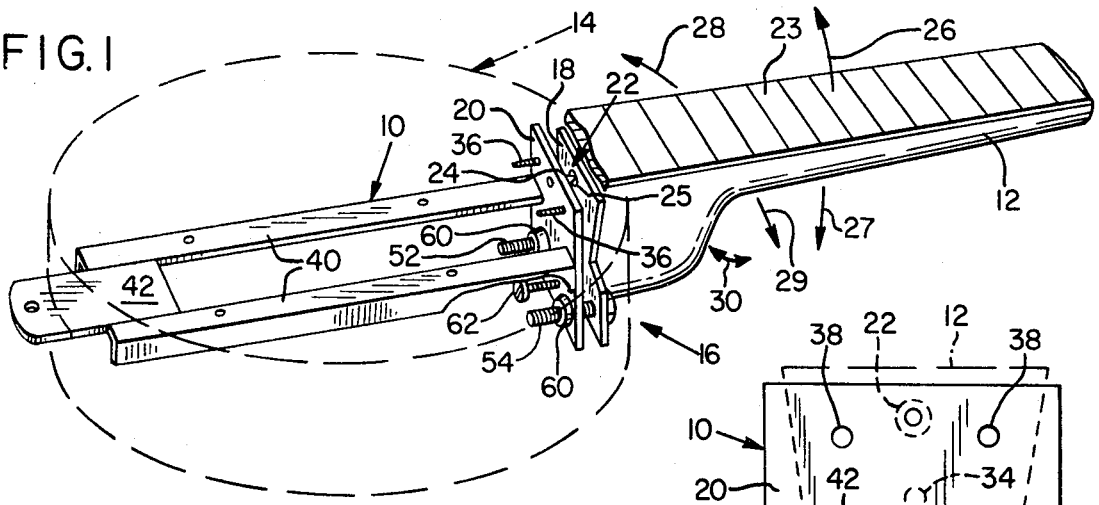
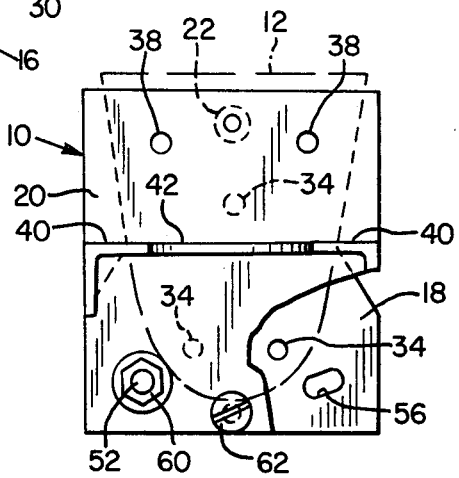
FIG. 3
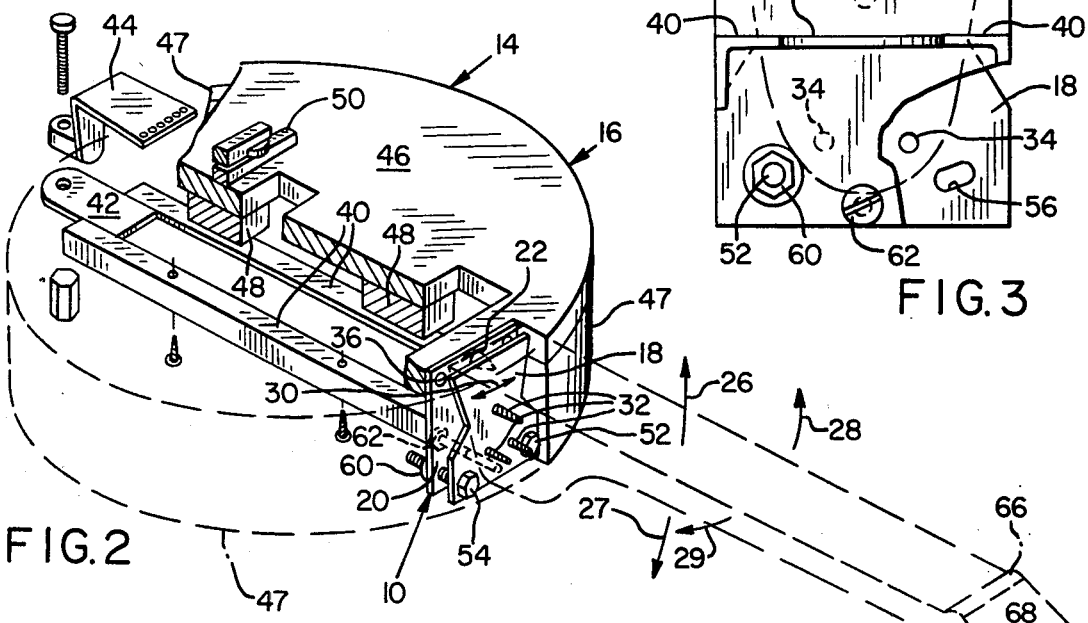
FIG. 2
FIG. 4
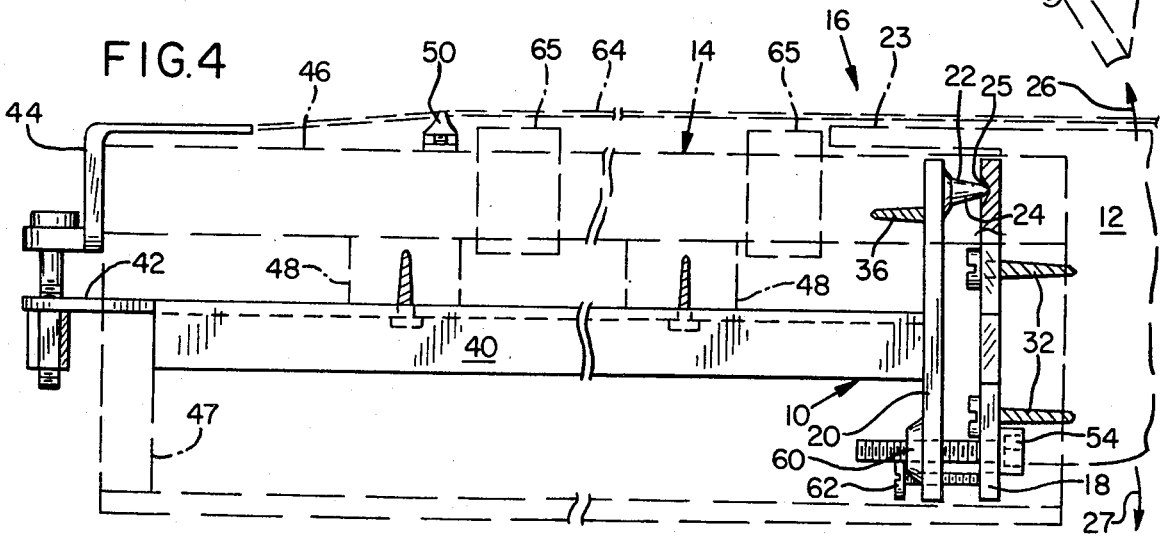

ADJUSTABLE NECK ATTACHMENT FOR STRINGED INSTRUMENTS

BACKGROUND OF THE INVENTION

The present invention relates to banjos and similar stringed instruments, and particularly to an apparatus for attaching the neck of such a stringed instrument to the body thereof.

Stringed musical instruments, such as banjos, guitars, and the like, comprise a body portion and an elongated neck which extends away from the body portion. A plurality of strings are attached to a tailpiece fastened to the body, the strings extending over a bridge, across the body, and along the neck. Ordinarily the neck is securely and permanently attached to the body of such an instrument during manufacture, and the relationship between the position of the strings and the surfaces of the neck and body of the instrument is variable only insofar as the height and location of a bridge resting on the top of the body portion of the instrument may be adjusted.

Particularly in the case of banjos, the body construction has a great deal of influence on the characteristic sound produced by the instrument. Because of the relatively high cost of well built banjos, it is sometimes desirable to provide for detachability of the neck from the body of such a banjo so that one neck may be used, for example, on an acoustical banjo body, as well as on a body equipped with electromagnetic pickups providing for amplification of the sound produced by the strings.

Adjustment of the neck with respect to the body of a stringed musical instrument may require adjustment of the height, vertical angle, lateral angle, and rotational position of the neck relative to the body of such an instrument.

Previously, in mounting a neck to the body of an instrument, it has commonly been the practice to adjust the position and angular orientation of the neck with respect to the body by the use of shims interposed as required between the base of the neck and the body at the point of attachment. While it is possible to provide acceptable results in this manner, the process of adjustment is tedious.

Adjustment of the angle between the top of the body and the top of the neck in a plane extending through the neck and the body, hereinafter referred to as a vertical plane, alters the height of the strings above the frets or fingerboard surface of the neck. Such adjustment is required because too great a height of the strings above the frets makes it impossible to stop the strings easily and efficiently on the frets, while too small a height of the strings above the frets can permit undesirable interference of the frets with the normal vibration of the string, causing an undesirable and annoying buzzing sound as the instrument is played.

Lateral adjustment of the neck with respect to the body, that is, adjustment of the angle in a plane parallel the neck and the top of the body, hereinafter referred to as a horizontal plane, affects the location of the outermost strings of the instrument relative to a respective edge of the neck. Lateral angle misalignment may result in a string extending alongside the neck, rather than above the fingerboard or fretboard, so that it is impossible to stop the string. Such misalignment also results in application of unbalanced lateral forces to the neck, which forces may eventually cause the neck to warp.

Rotational misalignment of the neck with respect to the body, about a longitudinal axis of the neck, may result in the strings on one side of the neck being further above the fingerboard or fretboard than strings on the other side, with the result that the instrument will be awkward to play. Particularly in the case of an electrically amplified instrument, such misalignment of the neck with respect to the body may also result in unequal spacing between the strings and the sensors intended to pick up the vibration of the individual strings for electrical amplification. This, of course, can result in different sound volume being produced by the different strings, or a requirement to make difficult adjustments to the amplifier.

Finally, the overall length of the instrument from the bridge to the nut at the head end of the neck must bear the proper physical relationship to the spacing between the frets of a fretboard, and in an instrument such as an electrically amplified guitar or banjo having a fixed bridge, inaccuracy of this length results in inaccuracy of at least some of the tones produced by the instrument.

Previous devices have attempted to deal with at least some of these problems, but without complete success. For example, Oleson U.S. Pat. Nos. 536,649, DeWick 1,567,359, Lange 1,611,648, Strube 1,671,942, Larson 1,818,631, and Bardsley 1,206,650 all provide for adjustment of the neck of a stringed musical instrument with respect to the body, about either one or two axes of rotation. While this may be acceptable in the case of conventional acoustical banjos, in which the bridge is movable, the result of misalignment with respect to the body is unacceptable in an instrument in which the position of the bridge is fixed.

What is needed, then, is an improved way of connecting the neck to the body of a stringed musical instrument such as an electric banjo, providing for adjustment of vertical location, vertical angle, lateral angle, and rotational position of the neck with respect to the body of the instrument in order to produce the accurate tones throughout the instrument's range.

SUMMARY OF THE INVENTION

The present invention overcomes the shortcomings of the previously known systems for attachment of a neck to the body of a stringed musical instrument by providing a neck attachment device which permits the neck to be easily detached and replaced on the body of such a stringed musical instrument and also provides for easily accomplished adjustment of length, vertical angle, lateral angle, and rotational position of the neck with respect to the body of the musical instrument.

In perhaps its most basic aspect, the device of the invention comprises a pair of adapter plates, one of which may be attached to the base of the neck of the instrument and the other of which may be attached to the body of the instrument. A single point pivot, for example a pointed metal cone, protrudes from one of the adapter plates, and a mating socket is provided in the other of the plates to generally locate the neck with respect to the body. The pivot may be adjustable to provide length adjustment of an instrument having a non-movable bridge.

Adjustment screws provide for both vertical angle and lateral angle adjustment of the position of the neck with respect to the body. Apertures provided in one of the adapter plates, through which the adjustment screws pass, are elongated to permit rotation or twisting of the neck with respect to the body of the instrument, about an axis extending through the pivot and along the length of the neck. A setscrew may be provided to oppose the force provided by the adjustment screws, thereby locking the neck into its position of adjustment with respect to the body.

A further aspect of the invention is the provision of a brace bar attached to the body adapter plate and extending away from the body adapter plate on the side opposite from the neck of the instrument, to provide physical stiffening of the body of the instrument, support of the body adapter plate relative to the body, and support for the tailpiece which retains one end of the strings. In the case of an electric banjo, the brace member may also provide a point of attachment and support for the top member of the body, on which the bridge and amplifier pickups are mounted.

In a preferred embodiment of the invention the single point pivot and socket are located near the tops of the respective adapter plates. A pair of adjustment screws are located equidistant from the single point pivot, near the bottom of the body and neck of the instrument. In this form of the device tension in the strings is counterbalanced by the tension in the adjustment screws, holding the pivot point securely engaged in the socket provided. A setscrew located centrally between the adjustment screws may be used to oppose the adjustment screws locking the neck in position with respect to the body of the instrument once adjustment has been completed.

It is therefore a primary objective of the present invention to provide an improved device for adjustably connecting the neck to the body of a stringed musical instrument.

It is another important objective of the present invention to provide a device which permits adjusting the position of the neck in all directions with respect to the body of a stringed musical instrument.

It is an important feature of the present invention that it includes a single pivot point between the neck and the body of a stringed musical instrument, permitting adjustment of the position of the neck in any direction with respect to the body.

It is an important advantage of the present invention that it securely holds the neck in a selected position with respect to the body of a stringed musical instrument, yet provides freedom of adjustability in more directions than have been available in previous devices for adjustable attachment of the neck to the body of a musical instrument.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a partially cut away pictorial view of the adjustable neck attachment device of the present invention in use in an electric banjo.

FIG. 2 is a partially cut away pictorial view, from another angle, of the adjustable neck attachment device and electric banjo shown in FIG. 1.

FIG. 3 is a sectional elevational view of the device of FIG. 1 as seen along line 3—3.

FIG. 4 is a partially cut away side elevational view of the adjustable neck attachment device and electric banjo shown in FIG. 1.

DETAILED DESCRIPTION OF THE INVENTION

Referring now to FIGS. 1 and 2 of the drawings, the adjustable neck attachment device 10 of the invention is shown in use to mount a neck 12 to a body 14 of an electric banjo 16.

The adjustable neck attachment device 10 of the invention comprises a neck adapter plate 18 and a body adapter plate 20 which are spaced slightly apart from one another and extend generally parallel to one another between the body 14 and the neck 12 of the banjo 16.

A single point pivot 22 is located between the adapter plates 18 and 20, preferably being centrally located with respect to the width of the neck 12 and being located near the top of the adjustable neck connecting device, that is, near the edges of the adapter plates 18 and 20 which are closest to the fretboard 23 which extends along the top of the neck 12. The single point pivot 22 may, for example comprise a protruding pointed member 24 mounted in the body adapter plate 20 and extending outwardly therefrom, the pointed end thereof being received in a conical socket 25 defined in the surface of the neck adapter plate 18.

As will be further explained herein, the location of the single point pivot 22 between the neck adapter plate 18 and the body adapter plate 20 permits adjustment of the relative positions of the neck 12 and the body 14 of the instrument to vary the vertical angle, tilting the neck 12 up or down with respect to the body 14 as indicated by the arrows 26 and 27, swinging the neck 12 laterally with respect to the body 14 as indicated by the arrows 28 and 29, or by rotating the neck 12 with respect to the body 14, about an axis extending generally along its length and passing through the single point pivot 22, as indicated by the arrow 30.

The neck adapter plate 18 is securely fastened to the neck 12, by fasteners such as screws 32 extending through apertures 34 defined in the neck adapter plate 18.

Similarly, the body adapter plate 20 may be securely attached to the body 14 by fasteners such as screws 36 extending through apertures 38 defined in the body adapter plate 20, into a portion of the body of the instrument where the neck 12 is to be attached. A pair of brace bars 40 which may be welded to the body adapter plate 20 extend generally perpendicularly away from the body adapter plate 20 toward the opposite side of the body 14 of the instrument. The brace bars 40 are connected to an end piece 42 which extends beyond the opposite side of the body 16, providing a point of attachment for a tailpiece 44.

In the particular embodiment of the invention shown in the drawings, the electric banjo 16 includes a top piece 46 which may preferably be made of wood into which the screws 36 extend from the body adapter plate 20. The neck 12 extends into a cutout area in the side of the top piece 46, permitting a shell 47 to be attached to the bottom of the top piece 46, surrounding the neck attachment device 10. Spacer blocks 48 support the top 46 a predetermined distance above the brace bars 40, providing structural strength and support for the top 46 and a bridge 50 which is mounted thereon.

With the shell 47 removed from beneath the top 46 to provide access to the attachment device 10, the angular position of the neck 12 with respect to the body 14 is adjusted by moving the neck adapter plate 18 relative to the body adapter plate 20. This relative movement is obtained primarily by adjusting a left adjustment screw 52 and a right adjustment screw 54 which extend through a pair of elongated apertures 56 defined preferably in the neck adapter plate 18. The elongated apertures 56 are located preferably in the lower portion of the neck adapter plate 18, that is, spaced farther from the fretboard 23 than the location of the single point pivot 22. The longitudinal axis 58 of each of the apertures 56 is preferably oriented approximately perpendicular to a radial line extending from the single point pivot 22 to the respective aperture 56, permitting relative rotation between the neck adapter plate 18 and the body adapter plate 20, while the adjustment screws 52 and 54 extend through the apertures 56. The adjustment screws 52 and 54 may extend preferably into nuts 60 attached, for example by welding to the body adapter plate 20.

A setscrew 62 extends through a threaded aperture in the body adapter plate 20 toward the neck adapter plate 18. As will be appreciated by those familiar with stringed musical instruments, the strings 64 extend from the tailpiece 44, passing over the bridge 50 and along the neck 12, being spaced slightly above electric amplifier pickups 65 and the fretboard 23, and passing over the nut 66 on the neck 12 of the instrument to the tensioning pegs 68. The setscrew 62 is preferably located further from the fretboard 23 than are the adjustment screws 52 and 54, and the combination of tension in the adjustment screws 52 and 54 acts against the pressure exerted by the setscrew 62 and the single point pivot 22.

To correct a rotational misalignment of the neck 12 with respect to the body 14, the neck adapter plate 18 can be rotated about the single point pivot 22. This is best accomplished with both the left and right adjustment screws 52 and 54 slackened somewhat, allowing the adjustment screws 52 and 54 to assume new positions within the elongated apertures 56. In this manner the neck 12 may be rotated in the desired direction about a longitudinal axis extending through the pivot 22 as indicated by the arrow 30 to raise one longitudinal edge of the fretboard 23 while lowering the opposite edge with respect to the strings 64. When the correct rotational position of the neck 12 has been set, the vertical and lateral positioning of the neck may be accomplished.

With some tension in the strings 64 and the setscrew 62 loosened, the vertical and lateral angular position of the neck 12 with respect to the body 16 of the electric banjo may be adjusted by tightening or loosening the adjustment screws 52 and 54. If both screws 52 and 54 are loosened or tightened equal distances, the angular position of the neck is adjusted with respect to the body in a vertical plane generally parallel to the length of the neck 12 and perpendicular to the top 46. As will be apparent, the height of the strings 64 above the surface of the fingerboard 23 will be increased if both of the adjustment screws 52 and 54 are slackened, permitting the neck to move upward, as indicated by the arrow 26. On the other hand, the strings 64 will be lowered toward the fretboard 24 if both of the adjustment screws are tightened, moving the neck as indicated by the arrow 27.

In most cases the length of protrusion of the pointed pivot member 24 from the body adapter plate 20 will be determined as a part of the design of the entire musical instrument. It is also possible, however, to provide for adjustment of the length of the protruding pointed member 24, as by provision of screw threads whereby the protruding pointed member 24 is fastened to the body adapter plate 20. Any change in the effective length of the strings 64 brought about by adjustment of the vertical angle relationship between the neck 12 and the body 16 may be accommodated by screwing the pointed pivot member 24 a compensating distance into or out of the body adapter plate 20.

The neck 12 may also be adjusted laterally, through an angle in the horizontal plane, generally parallel to the top 46 and the fretboard 23. The neck may be moved to the left as shown by the arrow 28 by loosening the right adjustment screw 54 while tightening the left adjustment screw 52 by an equal amount, or moved to the right, as indicated by the arrow 29 by the opposite procedure.

The adjustable neck attachment device 10 of the invention thus allows adjustability of the neck 12 with respect to the body 14 of a stringed instrument in all directions, providing precise location of the strings 64 with respect to the fretboard 24 and the electro-magnetic pickup elements of the electric banjo 16, and without changing the effective length of the strings 64.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a stringed musical instrument having a body, an elongate neck extending therefrom, and at least one string extending along said body and said neck, an adjustable neck attachment device for connecting said neck to said body, comprising:

(a) a neck adapter plate and means for attaching said neck adapter plate to said neck;

(b) a body adapter plate and means for attaching said body adapter plate to said body;

(c) single point pivot means associated with said neck adapter plate and said body adapter plate for permitting angular adjustment of the position of said neck adapter plate with respect to said body adapter plate about said single point pivot means;

(d) angle adjustment means extending between said body adapter plate and said neck adapter plate for adjusting the angular position of said neck with respect to said body by rotating said body and neck adapter plates with respect to one another about an axis extending through said pivot means and generally perpendicular to the length of said neck; and (e) rotational adjustment means associated with said angle adjustment means, for adjustably holding said neck in a selected position of rotation with respect to said body, about an axis extending generally along the length of said neck and through said pivot means.

2. The device of claim 1, said angle adjustment means comprising a pair of adjustment screws extending between said neck and body adapter plates at locations spaced apart from one another laterally with respect to said neck, at least one of said adjustment screws being spaced apart vertically with respect to said neck from the location of said single point pivot means.

3. The device of claim 2 wherein said rotational adjustment means comprises aperture means surrounding each of said adjustment screws for permitting rotation of said neck relative to said body, about said single point pivot means.

4. The device of claim 3 wherein each said aperture means comprises an elongated aperture having its length oriented generally perpendicular to a line extending from said single point pivot means to said elongated aperture.

5. The device of claim 2 wherein said single point pivot means is centrally located with respect to the width of said neck and said adjustment screws are equally spaced apart from said single point pivot means and located farther than said single point pivot means from said string.

6. The device of claim 1 including setscrew means extending from one of said adapter plates toward the other of said adapter plates, for locking said neck in a selected position of adjustment with respect to said body.

7. The device of claim 1 wherein said adapter plates are approximately parallel to each other, said single point pivot means comprising a pointed member outwardly disposed from one toward the other of said adapter plates, and an oppositely located socket defined in said other one of said adapter plates.

8. The device of claim 1, further comprising a brace bar connected to said body adapter plate and extending away from said body adapter plate on the side thereof opposite said neck adapter plate, for supporting said body in a predetermined orientation relative to said body plate.

9. The device of claim 8 wherein said brace bar includes means for attaching a tailpiece thereto.

* * * * *